US006694712B2

(12) United States Patent
Suolahti

(10) Patent No.: US 6,694,712 B2
(45) Date of Patent: Feb. 24, 2004

(54) FILM TREATMENT DEVICE AND WRAPPING APPARATUS

(75) Inventor: Yrjo Suolahti, Masku (FI)

(73) Assignee: Oy M. Haloila Ab, Masku (FI)

( * ) Notice: Subject to any disclaimer, the term of this patent is extended or adjusted under 35 U.S.C. 154(b) by 264 days.

(21) Appl. No.: 09/791,885

(22) Filed: Feb. 26, 2001

(65) Prior Publication Data

US 2001/0029725 A1 Oct. 18, 2001

(30) Foreign Application Priority Data

Mar. 22, 2000 (FI) ..... 20000673

(51) Int. Cl.[7] ..... B65B 11/00; B65B 61/10

(52) U.S. Cl. ..... 53/588; 53/375.9; 83/16; 83/171; 156/515; 219/243; 225/91

(58) Field of Search ..... 53/587–589, 210, 53/211, 218, 556, 389.3, 375.9; 219/243, 546, 548, 542; 225/93.5, 91; 83/171, 16; 156/515

(56) References Cited

U.S. PATENT DOCUMENTS

| | | | | | |
|---|---|---|---|---|---|
| 2,481,554 | A | * | 9/1949 | Winstead | 219/243 |
| 3,006,122 | A | * | 10/1961 | Weishaus | 53/568 |
| 3,047,991 | A | * | 8/1962 | Siegel et al. | 156/515 |
| 3,054,441 | A | * | 9/1962 | Gex et al. | 156/515 |
| 3,134,005 | A | * | 5/1964 | Mayhew | 83/171 |
| 3,253,122 | A | * | 5/1966 | Kochmer et al. | 219/243 |
| 3,291,963 | A | * | 12/1966 | Wetzel | 219/243 |
| 3,531,621 | A | * | 9/1970 | Beck | 219/243 |
| 3,614,383 | A | * | 10/1971 | Watts, Jr. | 156/515 |
| 3,916,148 | A | * | 10/1975 | LaFleur | 219/243 |
| 4,215,607 | A | * | 8/1980 | Hudson et al. | 83/111 |
| 4,288,968 | A | * | 9/1981 | Seko et al. | 53/550 |
| 4,396,449 | A | * | 8/1983 | Tumminia | 156/515 |
| 4,549,388 | A | * | 10/1985 | Lancaster | 53/556 |
| 4,583,352 | A | * | 4/1986 | Heron | 53/570 |
| 4,856,259 | A | * | 8/1989 | Woo et al. | 53/375.3 |
| 4,993,209 | A | * | 2/1991 | Haloila | 53/399 |
| 5,239,808 | A | * | 8/1993 | Wells et al. | 53/512 |
| 5,275,073 | A | * | 1/1994 | Zemlak et al. | 83/171 |
| 5,564,258 | A | * | 10/1996 | Jones et al. | 53/399 |
| 6,526,729 | B1 | | 3/2003 | Herava | |

FOREIGN PATENT DOCUMENTS

| | | | | |
|---|---|---|---|---|
| EP | 0 493 940 A1 | | 7/1992 | |
| EP | 0 634 328 | | 1/1995 | |
| FI | 91624 | | 4/1994 | |
| GB | 1 359 056 | | 7/1974 | |
| JP | 03098831 A | * | 4/1991 | B65B/53/02 |

* cited by examiner

*Primary Examiner*—Stephen F. Gerrity
(74) *Attorney, Agent, or Firm*—Lowe Hauptman Gilman & Berner LLP

(57) ABSTRACT

A film treatment device has a cutting device (2) for cutting a plastic film web (F). The cutting device (2) has an elongated electric resistor (5) fastened by both ends with fastening elements (3, 4), against which resistor the film web can be pressed and cut via heating of the electric resistor. The cutting device (2) also has a supporting element (6) arranged to support the electric resistor laterally substantially over the entire length of the electric resistor between the fastening elements (3, 4).

30 Claims, 11 Drawing Sheets

FILM TREATMENT DEVICE AND WRAPPING APPARATUS

TECHNICAL FIELD

The present invention relates to a film treatment device and a wrapping apparatus using a heating resistor to cut a wrapping film.

BACKGROUND ART

In prior art, various types of wrapping apparatus for wrapping a web of plastic film around an object to be packed are known. One of these types of wrapping apparatus comprises a film dispenser arranged to circulate around the object to be wrapped along a ring-like track while the object to be wrapped remains immovable during the wrapping operation. The movement of the film dispenser may be controlled by a circular guide rail or the film dispenser may be attached to a rotatable arm. The film runs from a roll in the film dispenser and is wrapped around the object. There are also wrapping apparatus in which the film dispenser is fixedly mounted on a column frame on a base and the object to be wrapped is circulated in relation to it on a rotating floor.

In conjunction with this type of wrapping apparatus, various film treatment devices are known e.g. from specifications WO 99/19216, U.S. Pat. No. 4,993,209, FI 91624 and EP 0493 940. Typically, a film treatment device comprises gripping means which can hold the film web at the beginning and end of the wrapping operation. Moreover, the film treatment device comprises a cutting device for cutting the film web at the end of the wrapping operation, and hot sealing means for seaming superincumbent film layers together near the cut-off line so that the end of the web remains fastened to the film layer below it.

The cutting and seaming means presented in specification WO 99/19216 comprises an infrared heat radiator disposed in a casing having apertures through which infrared radiation is directed through the film at a heat absorbing cutting and seaming stop block, which is thus heated and cuts the film, seaming the film layers placed against each other together. The use of an infrared heat source has the advantage of requiring practically no maintenance. However, the use of an infrared lamp involves the drawback of a relatively high price, requiring a high electric power and a bulky structure. Moreover, both the seaming and the cutting of the film are performed using the same heat source. The timing of the seaming and cutting operations cannot be adjusted independently of each other. If a wrapping film plastic type requires different cutting and seaming temperatures, then these cannot be adjusted independently of each other in each case.

In the wrapping apparatus presented in specification U.S. Pat. No. 4,993,209, a seaming and cutting device is used in which the film is cut and seamed by blowing hot air at the film. The problem is a varying seaming quality and an inaccurate cut-off line. Heating the air to a sufficient temperature and bringing it to the cut-off line is also difficult and disadvantageous in respect of energy economy.

Specifications FI 91624 and EP 0 493 940 present devices for cutting a film in which the film is cut by a cutting blade. The problem with a cutting blade is its risky nature. When the operator is changing the film roll and feeding in a new film to allow the gripping means to take hold of it, his hand may touch the cutting blade placed close to the roll.

Anyway, the closest example of prior-art technology is a film treatment device known from the applicant's "Octopus" wrapping machine in which the cutting device comprises an electric resistance wire held fast at both ends by fastening elements and extending freely without support between the fastening elements so that it is surrounded by an air space on all sides. At the end of the wrapping operation, the film web is pressed against the resistance wire and an electric current is passed through the wire, the wire being thus heated so that it cuts the film web.

The problem is that a repeated fatigue inducing load is transmitted from the film web to the areas near the points of attachment of the resistance wire, producing with time a fatigue fracture and breaking the wire. In addition, the thin resistance wire (diameter about 0.6 mm) is susceptible to breakage if the operator of the machine incautiously presses it when fitting the end of the film web to the gripping means placed near it. A further problem is that, as the film web is bent over the resistance wire, the area of contact between the film and the circumference of the resistance wire is fairly large, which means that the entire contact area has to be burned in order to cut off the web, thus producing noxious impurities in the air. If e.g. a film web of a width of 0.5 m is bent into an angle of 120 degrees over a 0.6 mm resistance wire, then for each cut an area of 3.15 $cm^2$ of plastic needs to be burned, producing smoke. A further problem is that plastic crust adheres to the wire, deteriorating its functional quality.

SUMMARY OF THE INVENTION

The object of the invention is to eliminate the above-mentioned problems.

A specific object of the invention is to provide a film treatment device in which the durability of the electric resistance wire has been improved so that it practically requires no maintenance at all. A further object of the invention is to provide a film treatment device that is safer and more reliable than earlier devices. An additional object of the invention is to provide a film treatment device in which the amount of plastic burned in the cutting operation is minimized.

According to the invention, the film treatment device comprises a supporting element arranged to support the electric resistor laterally substantially over the entire length of the electric resistor between the fastening elements. The supporting element constitutes a back stop for the electric resistor against the pressure of the film, keeping the resistor continuously firmly immovable in position.

The invention has the advantage that the arrangement for supporting the electric resistor makes it possible to achieve the same advantages as in the case of a device using an infrared radiator but in a simpler manner and at a lower cost. The susceptibility to damage of the electric resistor is reduced and its useful life considerably prolonged while a safer and more reliable device is achieved. In addition, the invention makes it possible to use an electric resistor in which the part coming into contact with the film is as narrow as possible so that the amount of plastic material burned in conjunction with the cutting is minimized. Besides, no plastic material will adhere around the electric resistor.

In an embodiment of the device, the electric resistor is of a band-like structure and is in cross-section substantially the shape of a flat rectangle. The supporting element comprises a slot designed to receive the band-like electric resistor partially inside it. The walls of the slot support the broad sides of the band laterally from both sides while the bottom of the slot supports the narrow edge of the band.

In an embodiment of the device, the slot has been fitted to receive the electric resistor inside it with a clearance to allow repeated thermal elongation and contraction of the electric resistor band.

In an embodiment of the device, that part of the supporting element which supports the electric resistor against the pressure of the film web is of a curved shape to give the electric resistor a curved shape, and the ends of the electric resistor are fastened to the supporting element so that at least one end is connected to the supporting element via a spring. The curvature of the electric resistor and the tension created in it by the spring are necessary to keep the electric resistor in the slot. Due to the curvature, the electric resistor is strained into a curved shape, which means that a force component directed at the support, such as the bottom of the slot, is generated in it, pressing the electric resistor toward the bottom of the slot and preventing it from slipping out of the slot when subjected to a lateral force that tends to pull it out of the slot. Without the curvature, the electric resistor might easily get out of the slot.

In an embodiment of the device, the electric resistor band comprises an outer edge which cuts the film, and an inner edge remaining inside the slot and resting on the bottom of the slot, which has a curvature designed to bend the electric resistor band into a curved shape.

In an embodiment of the device, the supporting element and the electric resistor are so fitted in the device that, while the electric resistor bends the film web stretched over it, the supporting element also bends the film web at points located on opposite sides of the electric resistor at a distance from its outer edge, so that after being cut, the film web tends to bend clear of the electric resistor.

In an embodiment of the device, the supporting element is made of an electrically insulating, substantially rigid and heat resistant material, e.g. phenol formaldehyde.

In an embodiment of the device, the thickness of the electric resistor band is of the order of about 0.2 mm.

In an embodiment of the device, the film treatment device comprises gripping means for gripping the film web.

In an embodiment of the device, the film treatment device comprises seaming means for seaming superimposed film layers together by means of heat.

BRIEF DESCRIPTION OF THE DRAWINGS

In the following, the invention will be described in detail by the aid of a few examples of its embodiments with reference to the attached drawing, wherein.

DETAILED DESCRIPTION OF THE INVENTION

Figure 1:
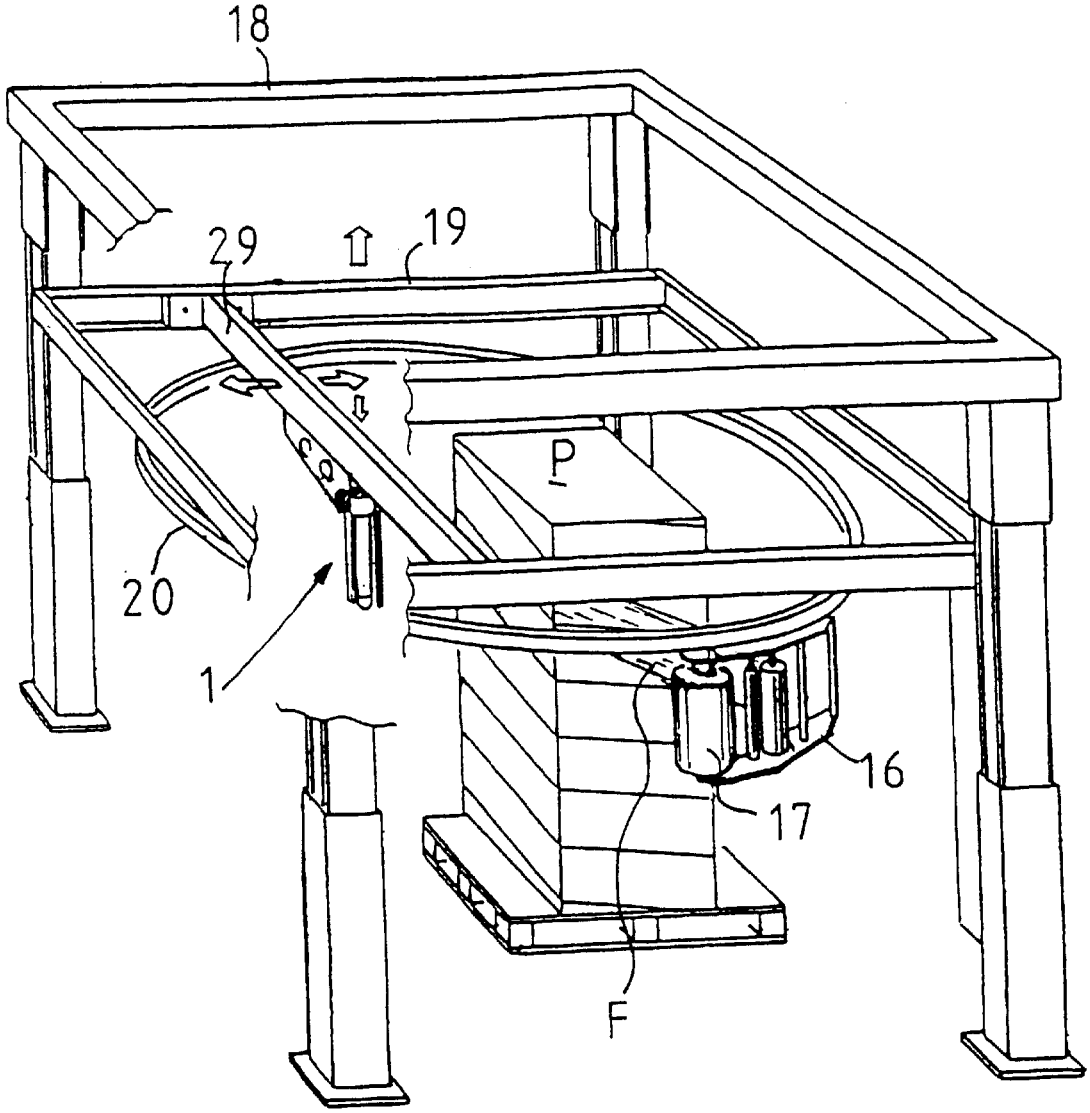
FIG. 1 presents an axonometric diagram of an embodiment of the wrapping apparatus of the invention provided with a film treatment device according to the invention, seen in an oblique top view.
Figure 2:
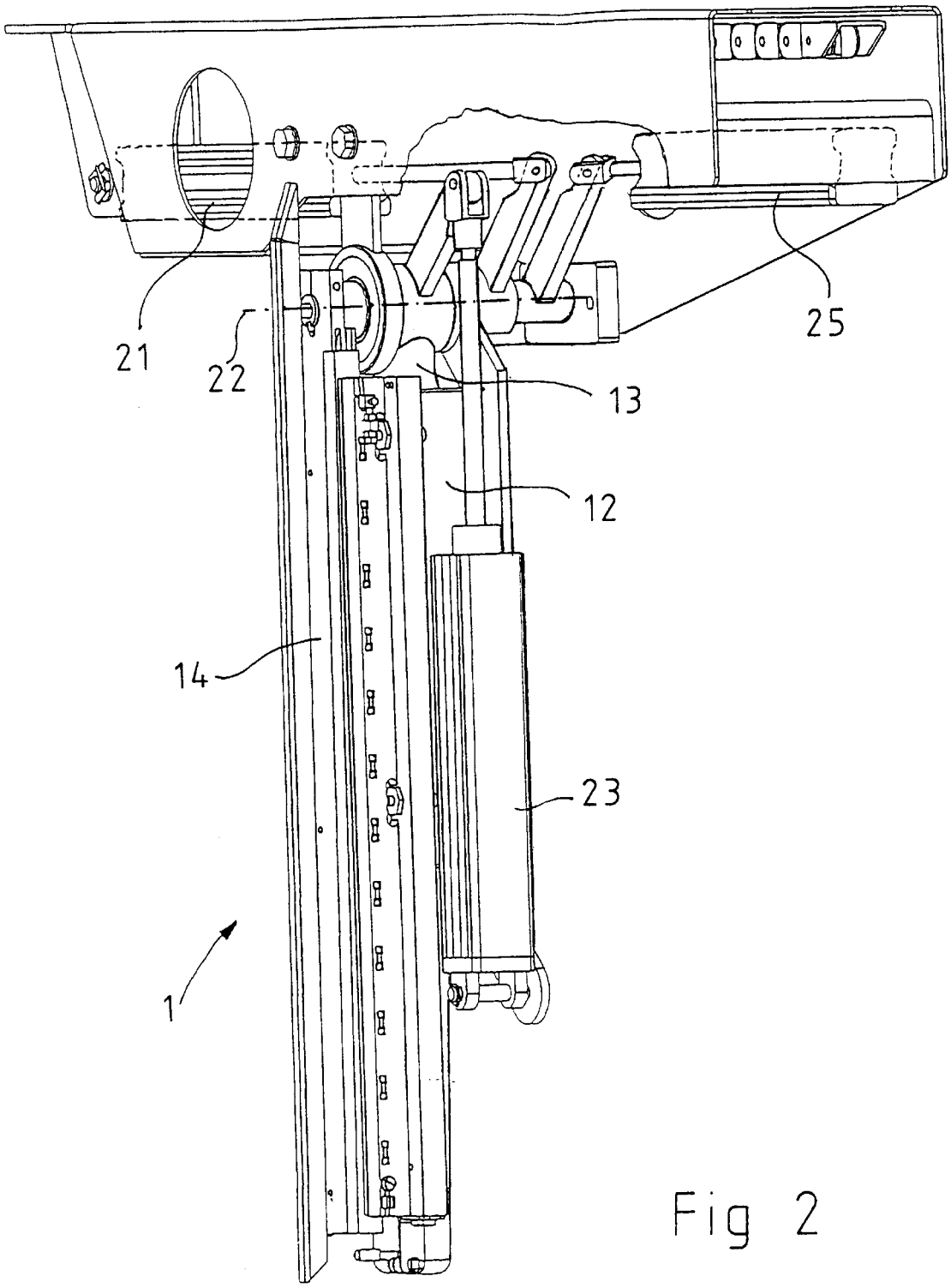
FIG. 2 presents an axonometric view of the film treatment device of the wrapping apparatus in FIG. 1.
Figure 3:
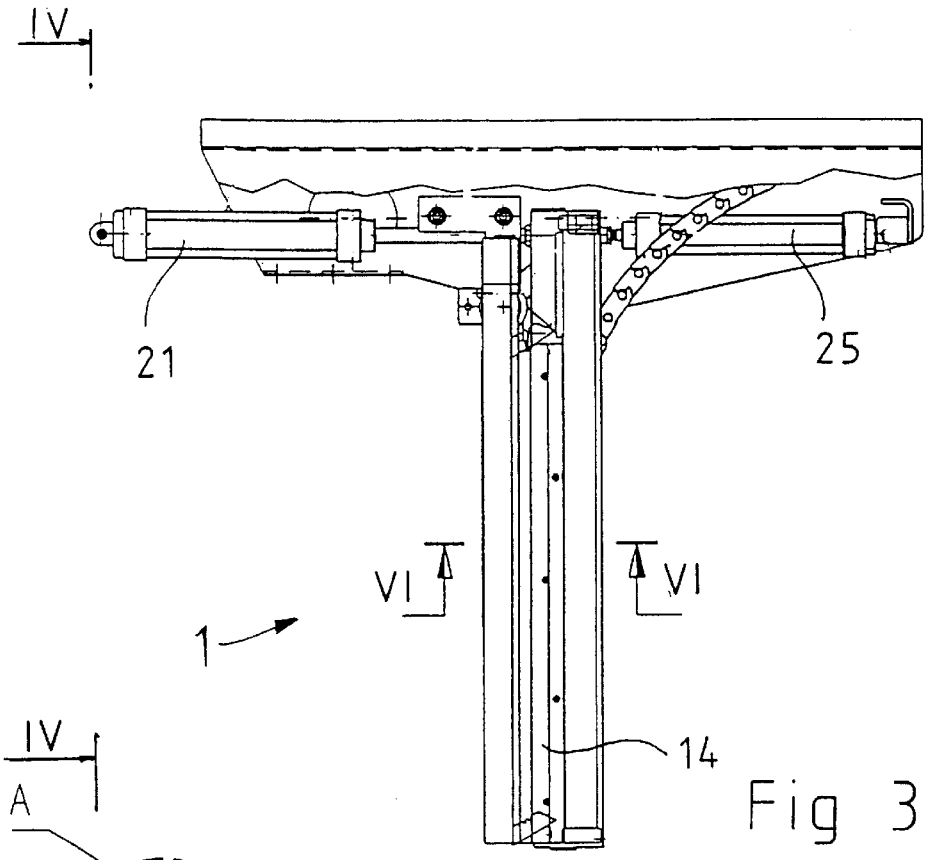
FIG. 3 presents the film treatment device of FIG. 2 in side view.
Figure 4:
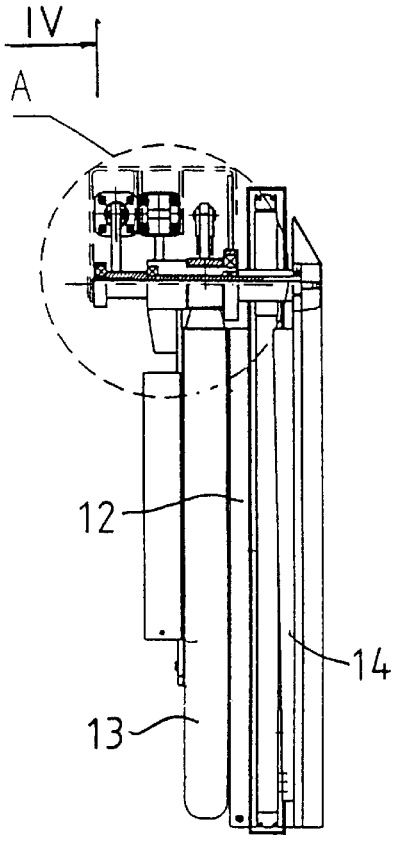
FIG. 4 presents the film treatment device of FIG. 3 as seen from the direction IV—IV.
Figure 5:
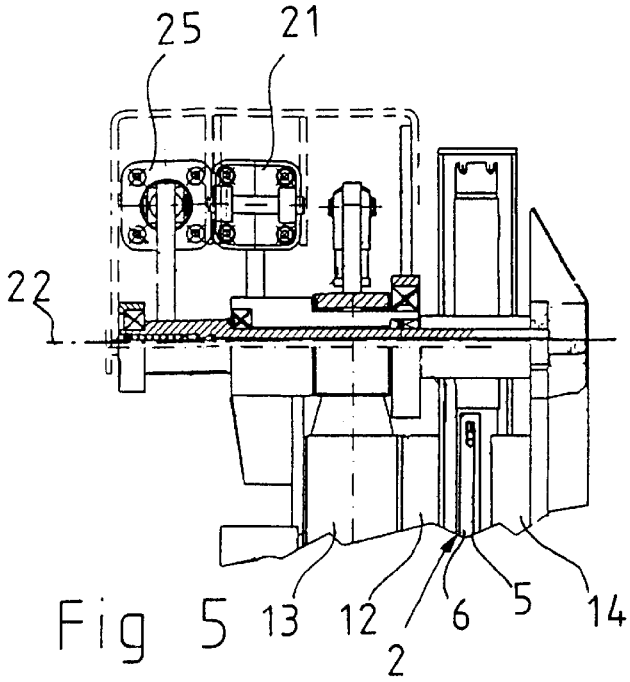
FIG. 5 presents detail A of FIG. 4.
Figure 6:
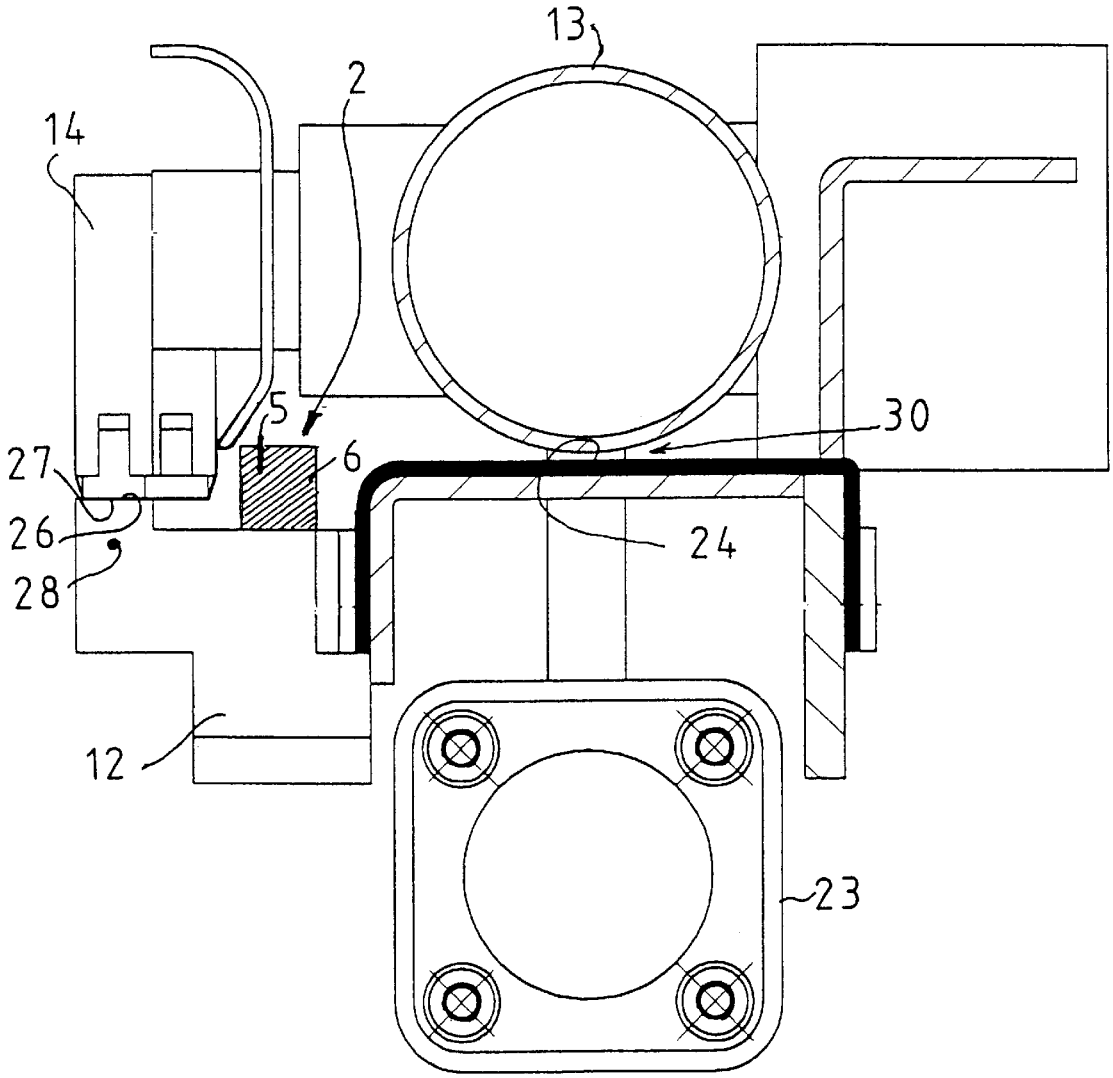
FIG. 6 presents a diagrammatic section VI—VI through the device in FIG. 3.

FIG. 1 shows a wrapping apparatus designed for winding a wrapping film (wrapping film) about a stationary product P to be packaged. The wrapping apparatus comprises a framework 18 mounted on a fixed base. A movable frame 19 can be moved vertically in relation to the framework 18. A circular ring guideway 20 is disposed in a horizontal plane and supported by the movable frame 19 so that it can move vertically in relation to the framework. The wrapping apparatus comprises a film dispenser 16, which has been arranged to move at a constant speed, driven by a drive motor (not shown) provided in the film dispenser 16, along a circular path as guided by the ring guideway 20 around the product P being packed. During the wrapping operation, the ring guideway 20, supported by the movable frame 19, is moved vertically to allow the film to be wound as a spiral wrapping about the product. Movably mounted on the movable frame 19 is a portal beam 29 with a film treatment device 1 mounted on it. By moving the portal beam 29 horizontally in relation to the movable frame 19, the film treatment device 1 can be moved towards and away from the product P being packed.

It is to be noted that the film treatment device 1 described here can be employed in any wrapping machine, e.g. one in which the film dispenser is connected to a rotating crank that circulates the film dispenser about a stationary product to be wrapped, or in a wrapping machine in which the film dispenser is connected to a fixed column and the product is rotated to wind the film around it.

FIGS. 2–6 present more detailed views of the film treatment device 1 and its components. As the device is, in other respects except for the arrangement of the invention for supporting the electric resistor 5, of a type known in itself (general construction known e.g. from specification U.S. Pat. No. 4,993,209), its structure will not be described here in detail except only as far as necessary for an understanding of the invention and the operation of the device.

As shown in FIGS. 2–6, the film treatment device 1 comprises means for gripping the film web and means for seaming superimposed film layers together via the application of heat. In addition, the film treatment device comprises a cutting device 2 for cutting off the film web along a line near the seam. In particular, the film treatment device comprises a frame 12, which can be turned by a first power means 21 between a vertical and a horizontal position about a swiveling axis 22. The device further comprises a hold bar 13, which can be turned about the swiveling axis 22 by a second power means 23. As can be seen from FIG. 6, the gripping means consist of a gap 30 between the circumference of the round hold bar 13 and a planar surface 24 of the frame 12 placed against the hold bar, said gap being fitted to hold in its grip a film web placed in it (see also FIGS. 12 and 23).

The film treatment device 1 further comprises a backing bar 14, which can be turned by a third power means 25 about the swiveling axis 22 between a vertical and a horizontal position. The frame 12 comprises a second stop face 26, which is disposed against a third stop face 27 in the backing bar 14, forming the seaming means, which are heated by an electric seaming resistor 28 embedded inside the frame 12 close to the stop face 26.

The film dispenser 1 further comprises a cutting device 2 for cutting off the plastic film web F. The cutting device 2 is mounted on the frame 12 between the above-mentioned seaming means and gripping means.

Figure 7:
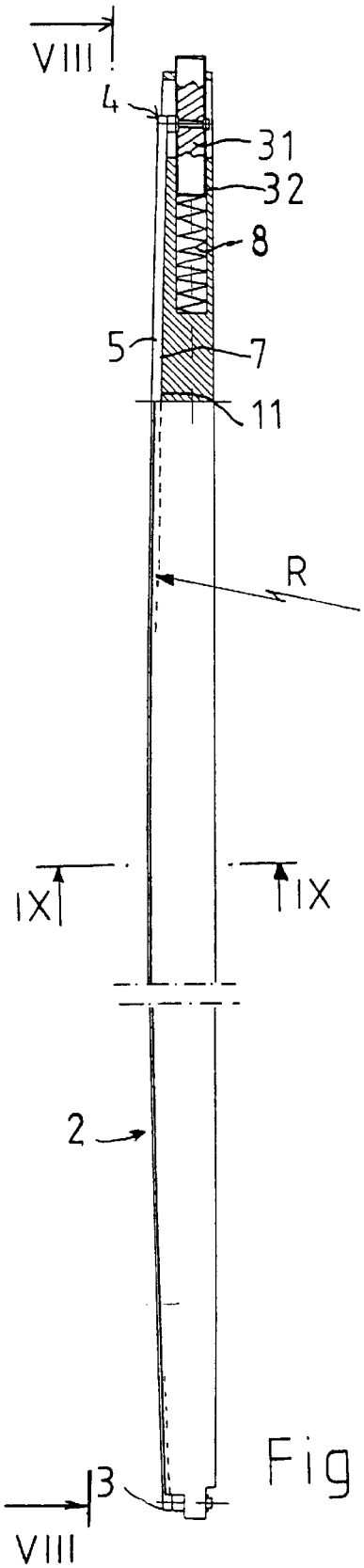
FIG. 7 presents a side view of the supporting element of the cutting device of the invention with an electric resistor band in the slot.
Figure 8:
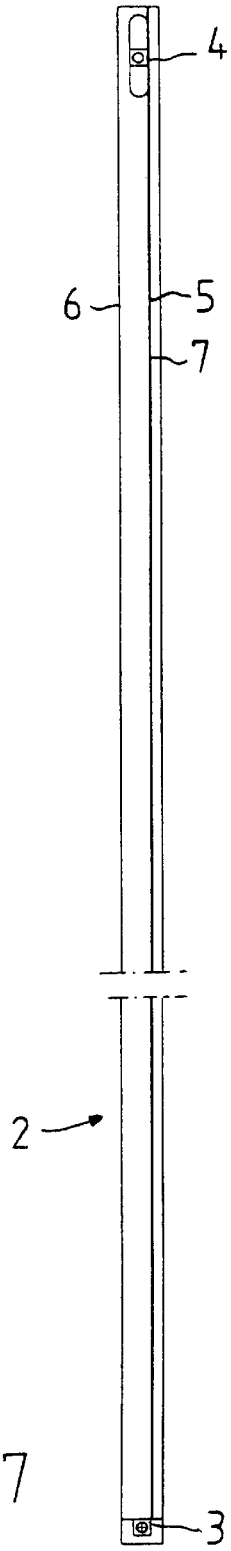
FIG. 8 presents the supporting element and resistor band of FIG. 7 as seen from the direction VIII—VIII.
Figure 9:
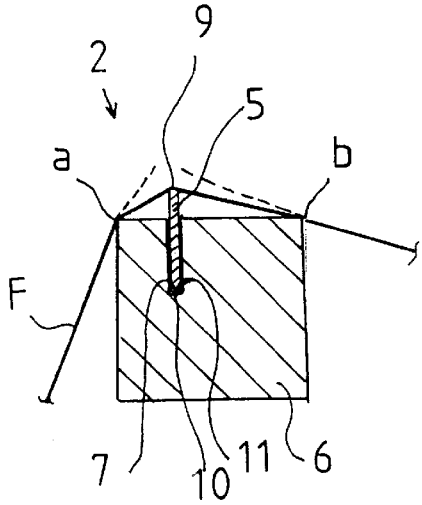
FIG. 9 presents a magnified section IX—IX of FIG. 7 with a plastic film bent over the supporting element and the outer edge of the electric resistor band so that the film can be cut.

The cutting device 2 is presented in greater detail in FIGS. 7–9. The cutting device 2 comprises an elongated supporting element 6, which can be fastened to the frame 12. The supporting element 6 is made of a dielectric material of a substantially rigid and heat-resistant nature, such as phenol formaldehyde (PF), which is also called "bakelite". The supporting element 6 is provided with a longitudinal slot 7, in which a band-like electric resistor 5 of a cross-sectional form resembling a flat rectangle is mounted with a clearance so as to allow thermal expansion and contraction of the band in the slot. The bottom 11 of the slot 7 supports the inner edge 10 of the electric resistor band 5 while the opposite walls support the two broad sides of the band. The outer edge 9 of the electric resistor band 5 extends somewhat upward from the surface of the supporting element 6. One end of the electric resistor band 5 is fixedly connected to the supporting element 6 with a fastening element 3. The other end of the electric resistor band 5 is connected to the supporting element 6 with a second fastening element 4, which comprises a slide block 31 movable along a guide 32 formed in the supporting element, said slide block being loaded by a spring 8 in the longitudinal direction to keep the band 5 tight in the slot 7. As can be seen from FIG. 7, the bottom 11 of the slot 7 has a slightly curved shape with a large radius R of curvature to bend the electric resistor band 5 into a corresponding curved shape. This again helps keep the band 5 in the slot 7.

Figure 23:
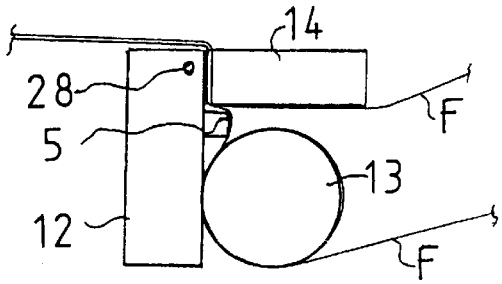

FIG. 9 illustrates how the electric resistor 5 bends the film web F stretched over it when the web is held in the grip of the seaming means on one side and of the gripping means on the other side of the resistor as illustrated in FIG. 23. The supporting element 6 causes the film web to bend at points a and b, which are close to the electric resistor 5 on opposite sides of it but still at a distance from it so that, after the film web has been cut off by instantaneously heating the electric resistor, the ends of the film web F tend to bend out clear of the electric resistor 5 as indicated with broken lines in FIG. 9.

The electric resistor band 5 used may be of a fairly thin construction as it is so well supported in the slot 7 in the supporting element 6. In one embodiment, the electric resistor band consists of a resistance band available under the trade name KANTHAL DSD, which has a width of 6 mm, a thickness of 0.2 mm and a specific resistance of 2.446Ω/m. In the example embodiment, the resistor strip has a resistance of 1.3Ω and it is supplied with a voltage of 24 V. The electric power is 500 W.

FIGS. 10–23 are diagrammatic illustrations of the operation of the film treatment device 1 at different stages during the wrapping of a stationary package P. The film dispenser 16 is simply represented by a film roll 17 from which the film is delivered.

Figure 10:
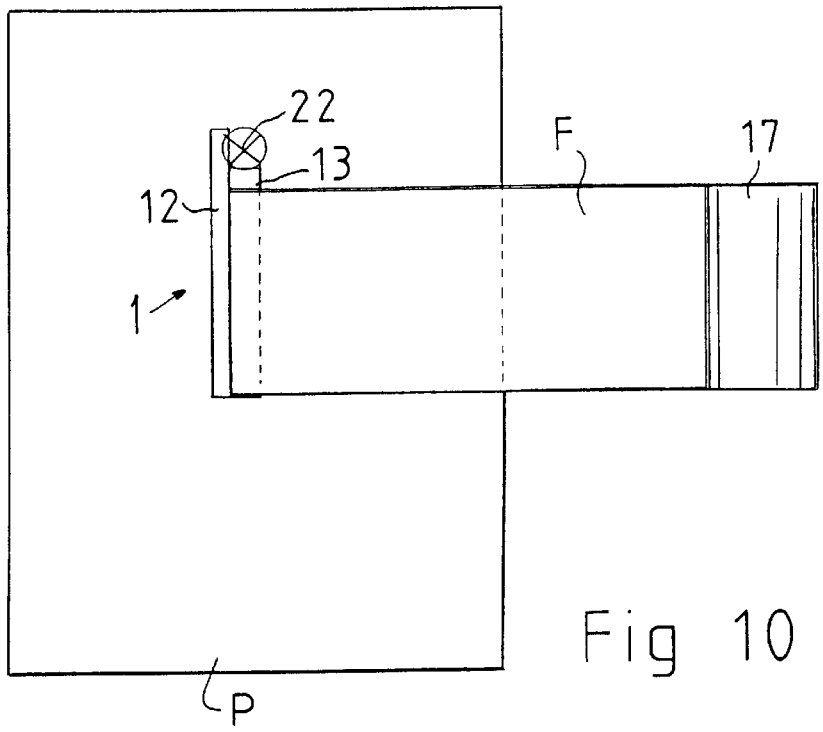
FIGS. 10–23 illustrate the operation of the film treatment device at different stages during the wrapping process.
Figure 12:
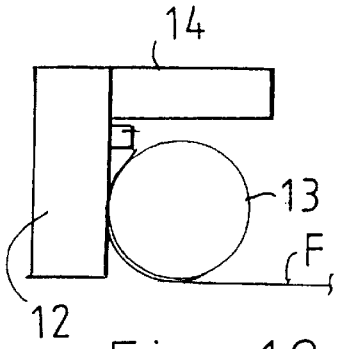

FIGS. 10 (side view) and 11 (top view) illustrate the initial phase of the process of wrapping a package P, in which situation the film F is held in the grip of the frame 12 and the hold bar 13, as can also be seen from the magnified detail in FIG. 12, while the frame 12, hold bar 13 and backing bar 14 are in the vertical position.

Figure 13:
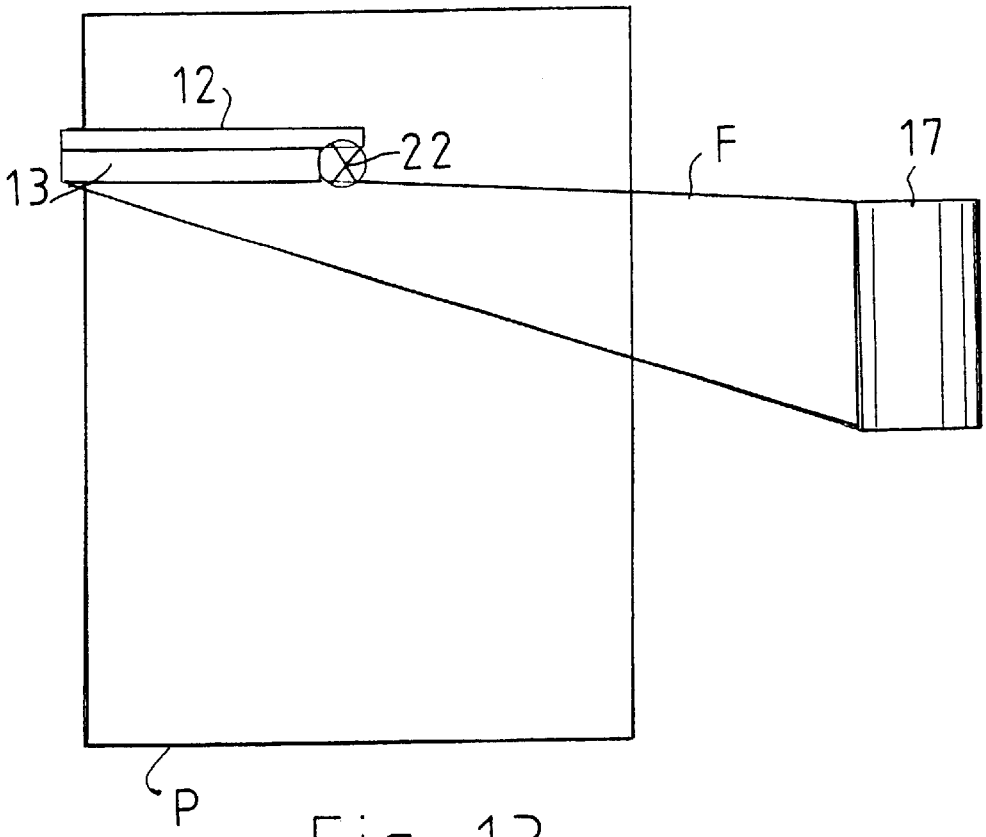
Figure 14:
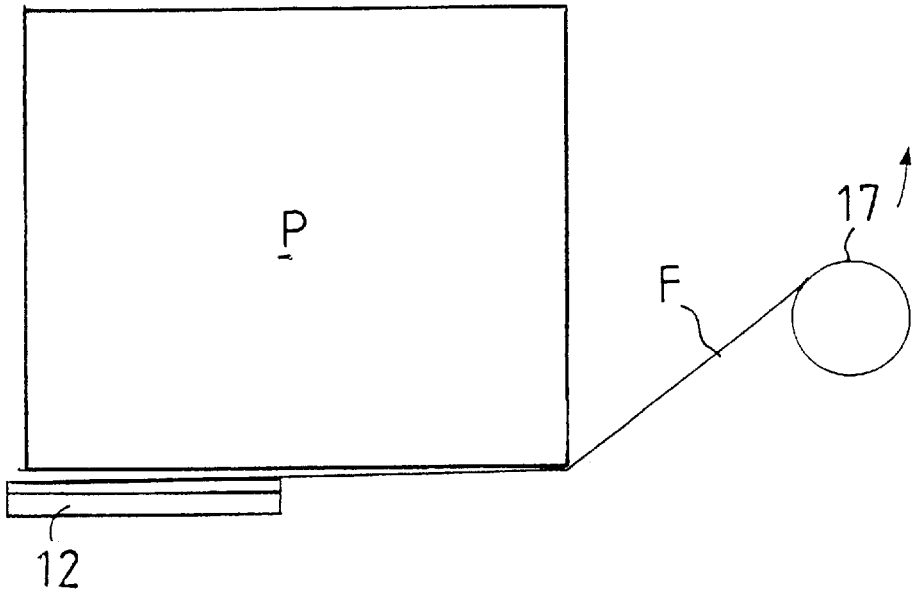

FIGS. 13 and 14 illustrate a situation at the beginning of the wrapping process when the assembly consisting of the frame 12, hold bar 13 and backing bar 14 has been turned about the swiveling axis 22 to the horizontal position with the film F still held in the grip of the frame 12 and hold bar 13 , so that the film can be wound about the package P without being hindered by these parts.

Figure 15:
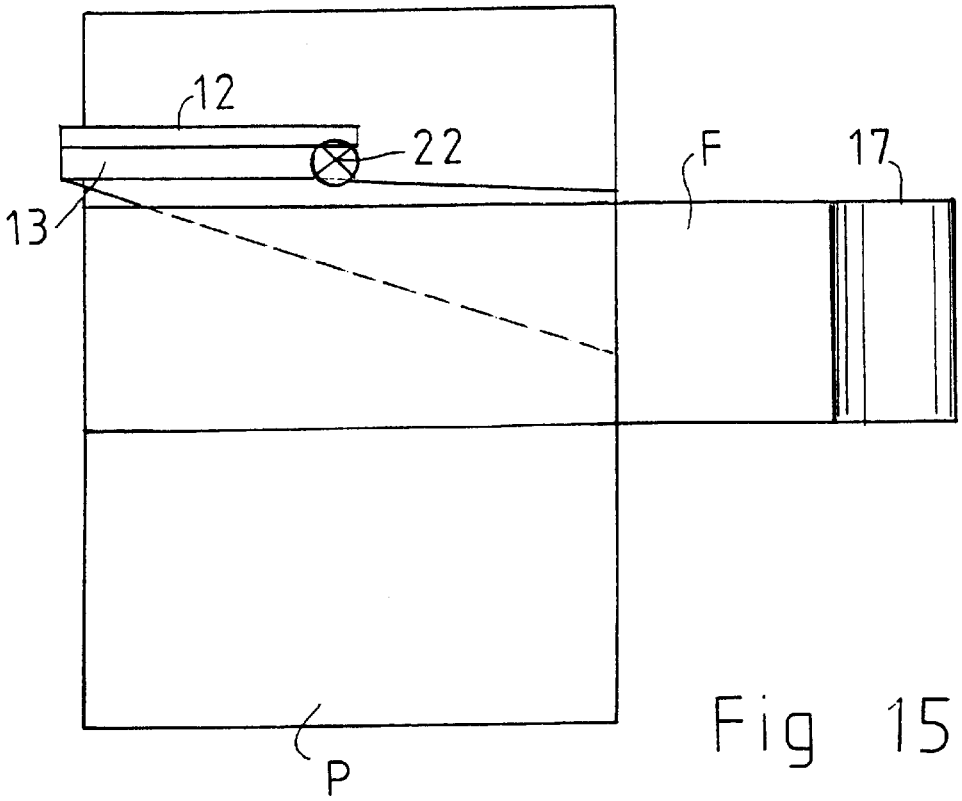
Figure 16:
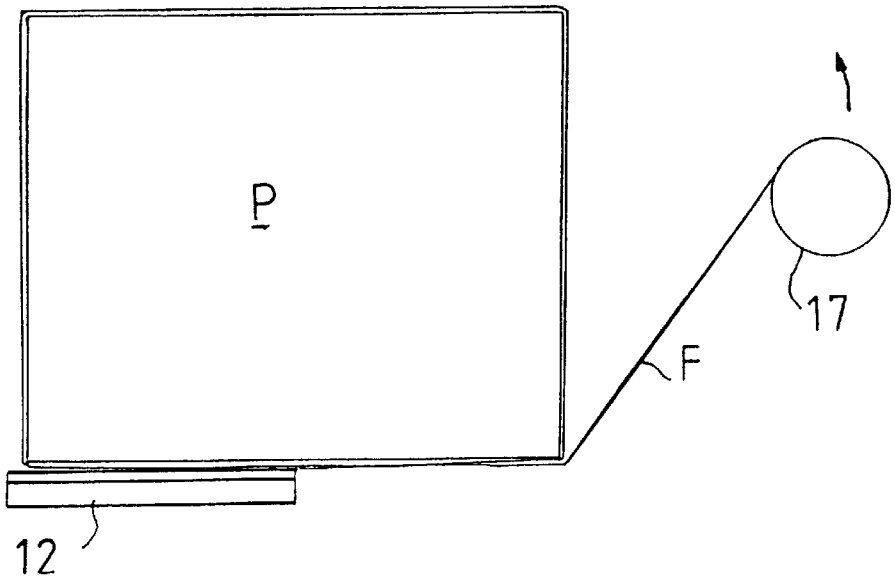

In FIGS. 15 and 16, the assembly of the frame 12, hold bar 13 and backing bar 14 is still in the same position as in FIGS. 13 and 14 and the film roll 17 has made one complete circle and part of a second circle about the package P. The film end remaining under one film layer can now be released from the grip of the frame 12 and hold bar 13.

Figure 17:
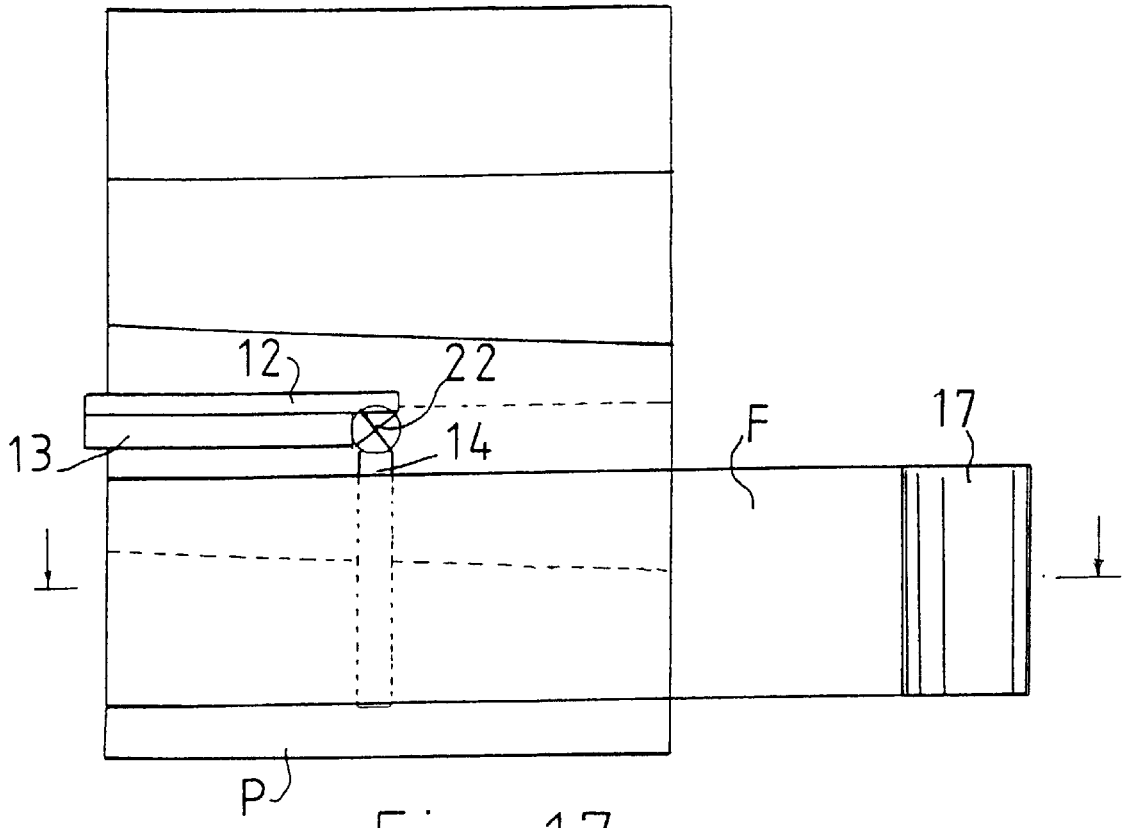
Figure 18:
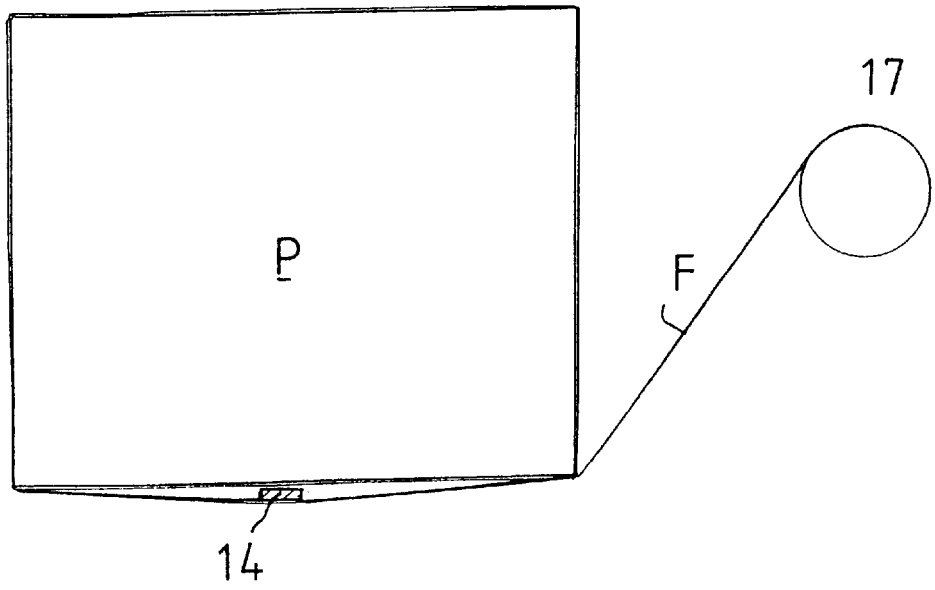

FIGS. 17 and 18 illustrate a situation at a final phase of the wrapping operation. The backing bar 14 has been turned about the swiveling axis 22 to the vertical position while the frame 12 and hold bar 13 still remain in the horizontal position, and the backing bar 14 is left between the film and the package P as the film is wound over the backing bar 14.

Figure 19:
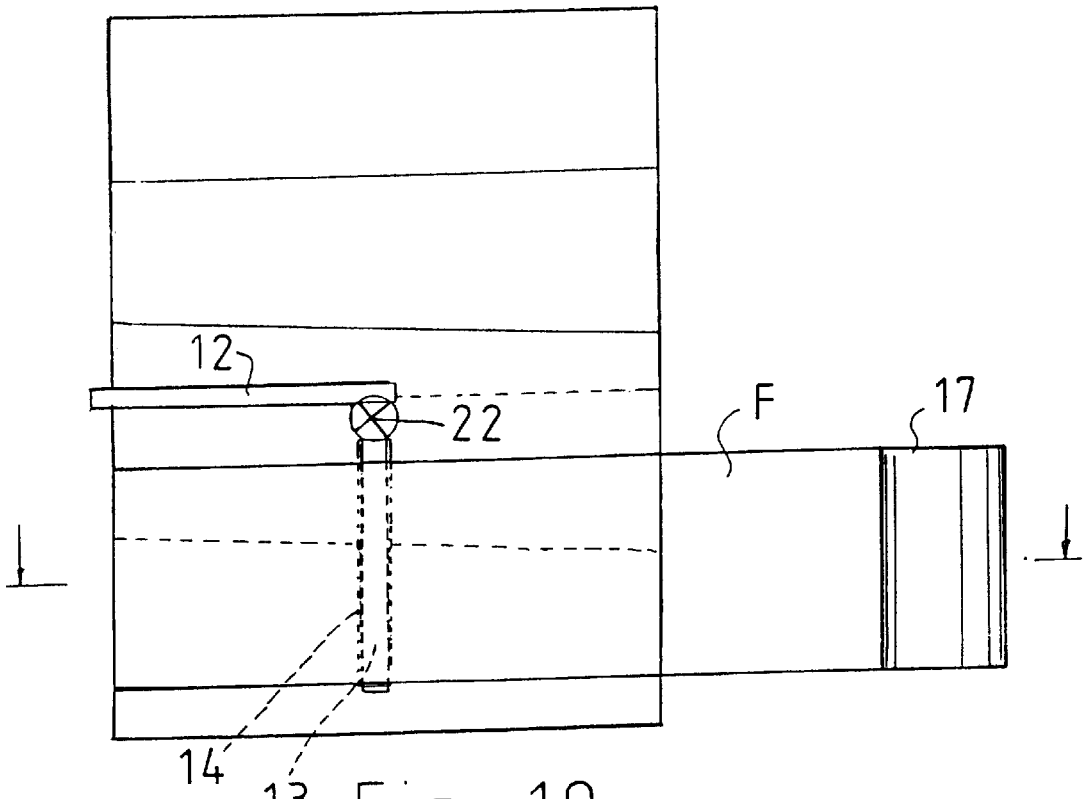
Figure 20:
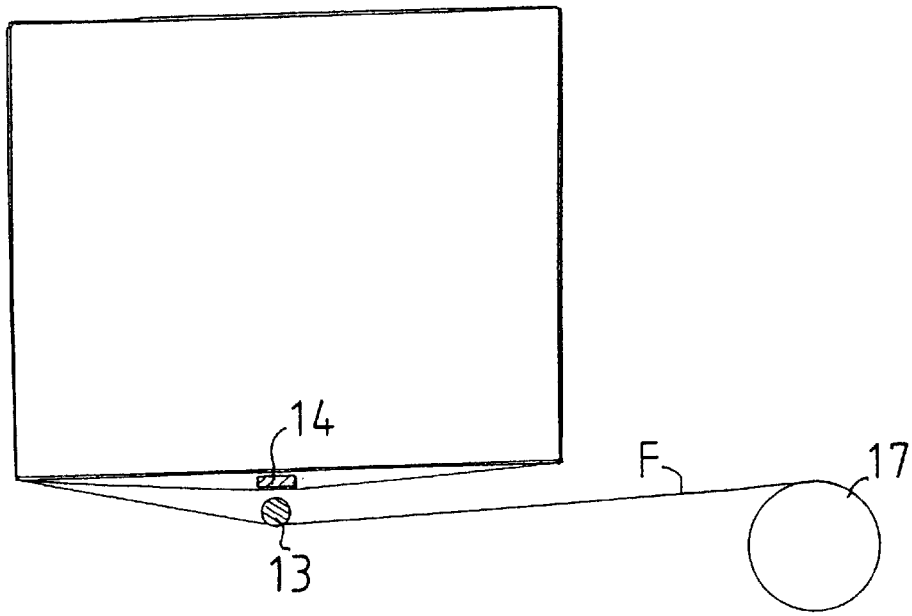

FIGS. 19 and 20 illustrate a situation where the film roll has made yet another circle about the package P after the situation in FIGS. 17 and 18. The hold bar 13 has been turned about the swiveling axis 22 into the vertical position and the film has been wound over the hold bar 13. The wrapping operation stops here.

Figure 21:
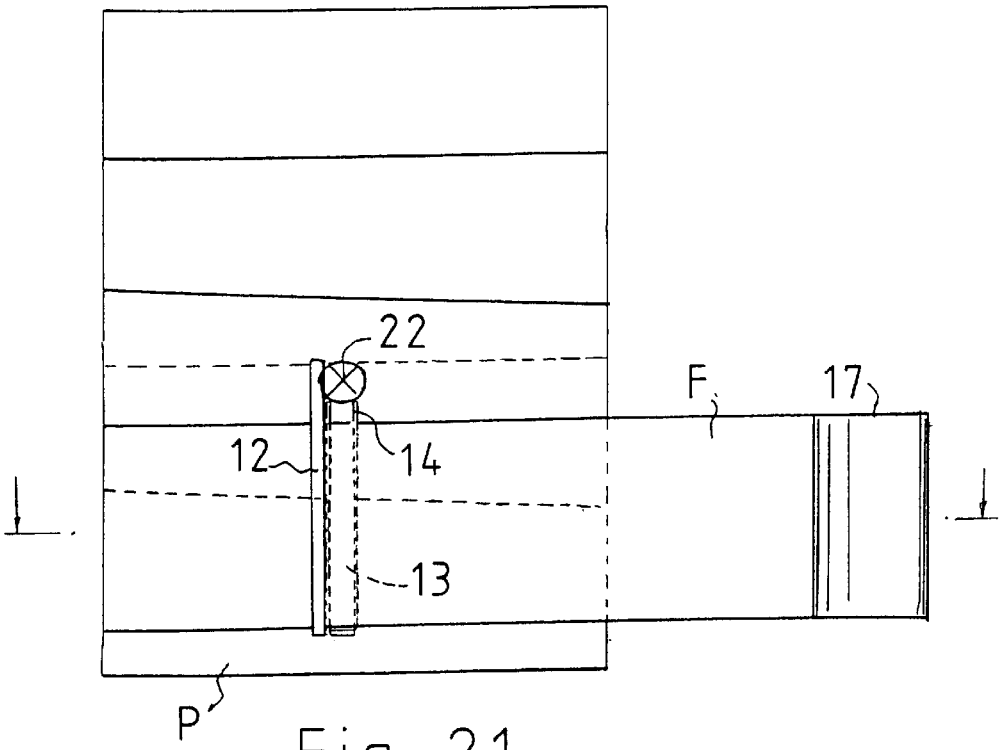
Figure 22:
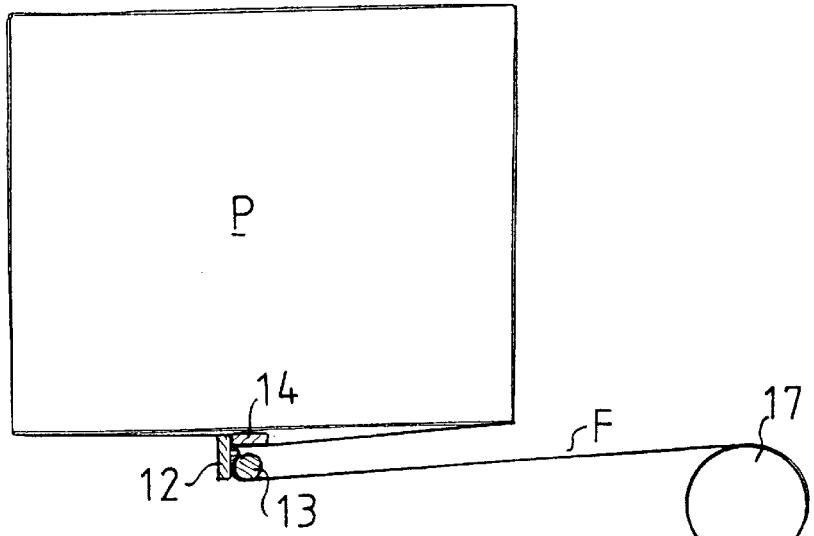

FIGS. 21–23 illustrate the final situation, where the frame has been turned about the swiveling axis 22 to the vertical position against the hold bar 13 and backing bar 14 in order to cut and seam the film. The electric resistor band 5 is heated by passing an electric current through it, whereupon it bums through the film F, thus cutting it off. At the same time, the electric seaming resistor 28 inside the frame 12 is heated by passing an electric current through it, thus heating it so that it welds together the film layers now lying one over the other between the stop face 26 of the frame and the stop face 27 of the backing bar 14 so that the tail of the film is fastened to the film layer below it. After that, the frame 12 and the hold bar 13 are turned to the horizontal position and the film treatment device 1 is moved upward, thus drawing out the backing bar 14 from under the last film layers on the package.

Figure 11:
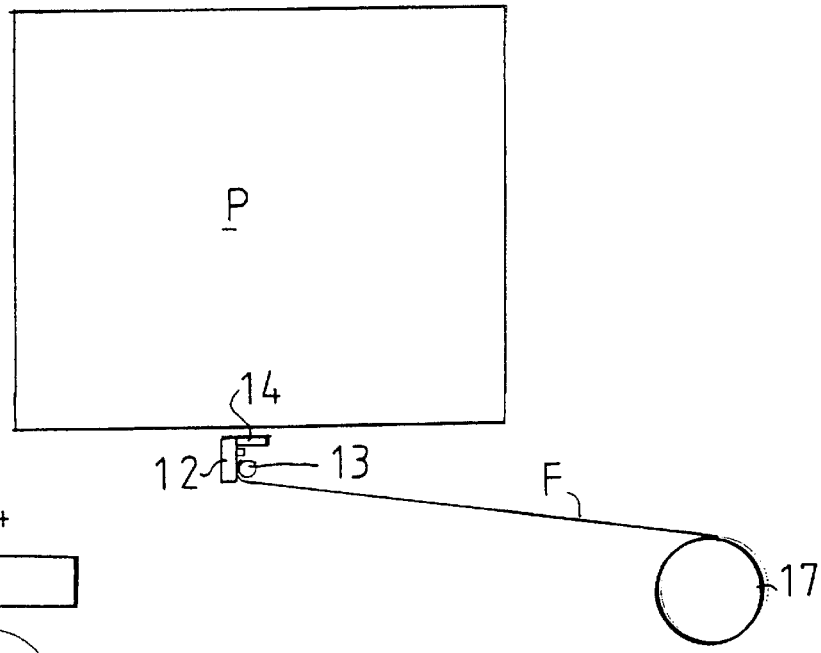

After this, the wrapped package P can be taken away and a new one can be brought in to be wrapped, starting again from a situation as illustrated in FIGS. 10–12.

The invention is not restricted to the examples of its embodiments described above; instead, many variations are possible within the scope of the inventive idea defined in the claims.

What is claimed is:

1. A film treatment device for use with a wrapping apparatus, said device comprising a cutting unit for cutting off a wrapping film, said cutting unit comprising:

an elongated electric resistor having opposite longitudinal end portions; and a supporting element supporting said resistor over a length of said resistor between the end portions;

wherein said supporting element has a longitudinal slot including an opening and a bottom;

said resistor is partially received in said slot and partially projects outside said slot, an outer edge of said resistor that projects outside said slot being adapted to be pressed against and cut off the wrapping film upon application of an electric current to said resistor; and an inner edge of said resistor that is received in said slot rests on the bottom of said slot, the bottom of said slot being curved toward the opening thereof to bend said resistor into a curved shape.

2. The device as defined in claim 1, wherein said resistor is a flat band of resistive material.

3. The device as defined in claim 2, wherein a thickness of said band is about 0.2 mm.

4. The device as defined in claim 3, wherein said band has a width greater than a depth of said slot, an inner part of said width being received in said slot, an outer part of said width, including said outer edge, projecting, in a depth direction of said slot, from the inner part to an outside of said slot.

5. The device as defined in claim 1, wherein said slot receives said resistor therein with a clearance to allow for thermal expansion and contraction of said resistor.

6. The device as defined in claim 1, wherein said supporting element further comprises film supporting portions adapted to come into contact with the wrapping film when the film is pressed against the outer edge of said resistor, wherein said film supporting portions are located on opposite sides and running longitudinally of said resistor; and planes defined by the outer edge of said resistor and said film supporting portions are slanted with respect to each other.

7. The device as defined in claim 6, further comprising a film gripping unit moveable relative to said cutting unit for pressing the wrapping film against the outer edge of said cutting unit and said film supporting portions, so that the film defines an angle with the outer edge of said resistor located at the apex of said angle.

8. The device as defined in claim 1, wherein said supporting element supports said resistor over an entire length of said resistor between the end portions.

9. The device as defined in claim 1, wherein said supporting element further comprises film supporting portions adapted to come into contact with the wrapping film when the film is pressed against the outer edge of said resistor, wherein said film supporting portions are located on opposite sides and running longitudinally of said resistor and together define a plane, said resistor extending from one side to the other side of the plane.

10. The device as defined in claim 1, further comprising a tension spring, wherein the end portions of said resistor are fastened to said supporting element with at least one of said end portions being connected to said supporting element via said spring.

11. The device as defined in claim 1, wherein a radius of a curvature of said bottom is larger than said length of said resistor.

12. A film treatment device for use with a wrapping apparatus, said device comprising a cutting unit for cutting off a wrapping film, said cutting unit comprising:

an elongated electric resistor having opposite longitudinal end portions, said resistor being adapted to be pressed against and cut off the wrapping film upon application of an electric current to said resistor;

a supporting element having a part that supports said resistor over a length of said resistor between the end portions; and a tension spring, wherein the end portions of said resistor are fastened to said supporting element with at least one of said end portions being connected to said supporting element via said spring;

wherein said part supports said resistor against a pressure of the wrapping film and has a curved shape so as to bend said resistor into a corresponding curved shape; and the curved shape of said resistor and a tension of said spring create a force component pressing said resistor toward said part in a direction of said pressure, thereby preventing said resistor from falling off said part when said resistor is subjected to a lateral force that tends to pull said resistor off said part.

13. The device as defined in claim 12, wherein said supporting element is made of electrically insulating, substantially rigid and heat resistant material.

14. The device as defined in claim 13, wherein said supporting element is made of phenol formaldehyde.

15. The device as defined in claim 12, wherein a radius of a curvature of said part is larger than said length of said resistor.

16. A film treatment device for use with a wrapping apparatus, said device comprising a cutting unit for cutting off a wrapping film, said cutting unit comprising:

an elongated electric resistor having opposite longitudinal end portions; and a supporting element supporting said resistor over a length of said resistor between the end portions;

wherein said supporting element has a longitudinal slot;

said resistor is partially received in said slot and partially projects outside said slot, an outer edge of said resistor that projects outside said slot being adapted to be pressed against and cut off the wrapping film upon application of an electric current to said resistor; and said device further comprises a film seaming unit for seaming superimposed layers of the film together by means of heat, said film seaming unit including a resistor different from the resistor of said cutting unit.

17. The device as defined in claim 16, wherein the resistor of said film seaming unit and the resistor of said cutting unit are stationary with respect to each other and are both mounted on a frame of said device.

18. A wrapping apparatus for wrapping a wrapping film around an article to be packed, said wrapping apparatus comprising a film dispenser for winding the wrapping film from a roll around the article to be packed and a film treatment device, said device comprising:

gripping means for gripping the film web; and cutting means for cutting off the wrapping film, said cutting means comprising resistive means for physically contacting and cutting off the wrapping film when said gripping means press the film against said resistive means and an electric current is applied to said resistive means; and supporting means for supporting said resistive means, over an entire length of said resistive means, against a pressure of the wrapping film being pressed by said gripping means against said resistive means.

19. The wrapping apparatus as defined in claim 18, wherein said resistive means comprise a resistor which is a flat band of resistive material, and that said supporting means comprise a slot in which said resistor is partially received.

20. The wrapping apparatus as defined in claim 19, wherein said slot receives said resistor therein with a clearance to allow for thermal expansion and contraction of said resistor.

21. The wrapping apparatus as defined in claim 19, wherein an inner edge of said resistor that is received in said slot rests on a bottom of said slot, said bottom having a curvature to bend said resistor into a curved shape.

22. The wrapping apparatus as defined in claim 21, wherein said bottom is curved toward an opening of said slot.

23. The wrapping apparatus as defined in claim 19, wherein a thickness of said band is about 0.2 mm.

24. The wrapping apparatus as defined in claim 19, wherein said band has a width greater than a depth of said slot, an inner part of said width being received in said slot, an outer part of said width projecting, in a depth direction of said slot, from the inner part to an outside of said slot.

25. The wrapping apparatus as defined in claim 18, wherein said resistive means comprise an elongated resistor, said supporting means having a part which supports said resistor and has a curved shape so as to bend said resistor into a corresponding curved shape.

26. The wrapping apparatus as defined in claim 25, wherein longitudinally opposite end portions of said resistor are fastened to said supporting means with at least one of said end portions being connected to said supporting means via a spring.

27. The wrapping apparatus as defined in claim 18, wherein said supporting means further comprise film bending means for bending the wrapping film when the film is pressed against said resistive means, wherein said film bending means are located on opposite sides of and spaced from said resistive means, so that, after being cut off, the film tends to bend clear of said resistive means.

28. The wrapping apparatus as defined in claim 18, further comprising a framework mounted on a fixed base;

a movable frame moveable vertically in relation to the framework; and a circular ring guideway disposed in a horizontal plane and supported by the movable frame;

wherein the film dispenser is moveable along the ring guideway around the article being packed and the film treatment device is mounted on the movable frame so that the device is moveable towards and away from the article being packed.

29. The wrapping apparatus as defined in claim 18, further comprising film seaming means for seaming superimposed layers of the film together by means of heat, said film seaming means including resistive means different from the resistive means of said cutting means.

30. The wrapping apparatus as defined in claim 29, wherein the resistive means of said film seaming means and the resistive means of said cutting means are stationary with respect to each other and are both mounted on a moveable frame of said device.

* * * * *